US005975845A

United States Patent [19]

Ball

[11] Patent Number: 5,975,845

[45] Date of Patent: Nov. 2, 1999

[54] TURBOMACHINERY ABRADABLE SEAL

[75] Inventor: Kenneth Ball, West Yorkshire, United Kingdom

[73] Assignee: Holset Engineering Company, Ltd., Huddersfield, United Kingdom

[21] Appl. No.: 08/849,568

[22] PCT Filed: Oct. 7, 1996

[86] PCT No.: PCT/GB96/02430

§ 371 Date: Jul. 10, 1998

§ 102(e) Date: Jul. 10, 1998

[87] PCT Pub. No.: WO97/13958

PCT Pub. Date: Apr. 17, 1997

[30] Foreign Application Priority Data

Oct. 7, 1995 [GB] United Kingdom ..... 9520497

[51] Int. Cl.[6] ..... F01D 11/12; F01D 11/02

[52] U.S. Cl. ..... 415/173.4; 415/200

[58] Field of Search ..... 415/9, 173.4, 174.4, 415/200

[56] References Cited

U.S. PATENT DOCUMENTS

| | | | |
|---|---|---|---|
| 3,545,944 | 12/1970 | Emanuelson et al. | 415/174.4 X |
| 3,817,719 | 6/1974 | Schilke et al. | 415/173.4 X |
| 3,879,831 | 4/1975 | Rigney et al. | 415/173.4 |
| 4,249,913 | 2/1981 | Johnson et al. | 415/173.4 X |
| 4,251,272 | 2/1981 | Sara | 415/174.4 X |
| 4,269,903 | 5/1981 | Clingman et al. | 415/173.4 X |
| 4,395,196 | 7/1983 | Plautz | 415/200 X |
| 5,185,217 | 2/1993 | Miyamoto et al. | 415/173.4 X |
| 5,472,315 | 12/1995 | Alexander et al. | 415/173.4 |

*Primary Examiner*—John E. Ryznic
*Attorney, Agent, or Firm*—Gary M. Gron

[57] ABSTRACT

A centripetal turbine (1) comprises a housing (3) and a turbine wheel (4) mounted within the housing (3) and having turbine blades (5). The housing (3) defines an annular inlet passageway (7) arranged around a portion of the turbine wheel (4), and an outlet passageway (8) which has a generally cylindrical portion arranged around a portion of the turbine wheel (4). The housing (3) also defines a curved annular shoulder (9) curving radially outwards from the generally cylindrical portion of the outlet passageway (8) to the annular inlet passageway (7). The radially outer edge of each turbine blade (5) has a first portion (11) adjacent the generally cylindrical portion of the outlet passageway (8), and a second curved portion (12) adjacent the curved annular shoulder (9). The housing (3) is provided with an annular layer (13) of an abradable material covering substantially all of the substantially cylindrical portion of the outlet passageway (8) but at most only a relatively small annular portion of the curved shoulder (9) adjacent the cylindrical portion of the outlet passageway (8).

18 Claims, 1 Drawing Sheet

TURBOMACHINERY ABRADABLE SEAL

TECHNICAL FIELD

The present invention relates to improvements in centripetal turbines and compressors, and particularly, but not exclusively, turbines and compressors incorporated in turbochargers.

BACKGROUND OF INVENTION

Centripetal turbines generally comprise a turbine wheel mounted within a turbine housing, the inner wall of which defines an annular inlet passageway arranged around the turbine wheel and a generally cylindrical axial outlet passageway extending from the turbine wheel. The arrangement is such that pressurised gas admitted to the inlet passageway flows to the outlet passageway via the turbine wheel, thereby driving the turbine wheel.

Where the outlet passageway meets the inlet passageway the inner wall of the turbine housing curves radially outwards forming a curved annular shoulder. The radially outer edges of the turbine wheel blades are profiled to substantially follow the profile of the housing, having a first portion in the region of the inlet passageway which is typically straight, a second curved portion which follows the contour of the curved annular shoulder, and a third substantially straight portion which extends into the outlet passageway.

The turbine blades are designed to follow closely the profile of the housing in order to minimise the gap between the two which is necessary to maximise efficiency. However, minimising the gap between the tips of the turbine blades and the inner wall of the housing is problematical because of the differential thermal expansion of the various turbine components as the turbine temperature rises to its operating temperature.

Conventionally turbines have been constructed with a clearance gap between the blade tips and the housing to allow for the differential expansion. However, given that turbines are generally designed for operating over a range of temperatures a compromise must be reached; either a gap large enough to allow for differential expansion at all extreme operating temperatures must be provided, which will result in an undesirably large gap at certain operating temperatures, or only a relatively small clearance gap may be provided and it be accepted that at least in some, albeit transient, operating conditions the turbine blades will rub against the housing (this could obviously result in rapid wear and in some cases damage to the turbine components).

Various approaches have been adopted to tackle this problem, one such approach being to coat the inner wall of the turbine housing with an annular layer of an abradable material adjacent the turbine blade tips, i.e. covering the curved internal shoulder and that part of the outlet passageway which surrounds the turbine wheel. This allows the turbine to be constructed with essentially zero clearance between the turbine wheel and the housing, with the turbine wheel effectively machining its own clearance as it rotates. Various different materials have been proposed as suitable abradable coatings, see for example U.S. Pat. No. 5,185,217.

Whilst the above solution is effective, it is also relatively expensive both in terms of the abradable materials used and the associated processes of coating the turbine housing with a given abradable layer.

SUMMARY OF THE INVENTION

It is an object of the present invention to obviate or mitigate the above disadvantages.

According to a first aspect of the present invention there is provided a centripetal turbine comprising a housing, a turbine wheel mounted within the housing and having turbine blades, the housing defining an annular inlet passageway arranged around a portion of the turbine wheel, an outlet passageway which has a generally cylindrical portion arranged around a portion of the turbine wheel, and a curved annular shoulder curving radially outwards from said generally cylindrical portion of the outlet passageway to said annular inlet passageway, the radially outer edge of each blade each having a first portion adjacent the generally cylindrical portion of the outlet passageway and a second curved portion adjacent the curved annular shoulder, wherein the housing is provided with an annular layer of an abradable material covering substantially all of said substantially cylindrical portion of the outlet passageway and at most only a relatively small annular portion of the curved shoulder adjacent said cylindrical portion of the outlet passageway.

We have made the surprising discovery that by terminating the abradable coating at/or adjacent to the annular region where the outlet passageway meets the curved shoulder, which represents a significant saving in manufacturing cost, there is virtually no loss in turbine performance. This is in marked contrast to conventional turbine designs in which abradable coatings are provided so as to cover the entire surface of the turbine housing adjacent to the turbine blades.

Any suitable abradable material may be used, such as the various materials proposed in the prior art. However, we have found that further cost savings can be made by using a material which comprises a mixture of nickel powder with aluminium powder and a binder, in which the nickel content is approximately 90% to 96% by weight and the aluminium content is approximately 3% to 7% by weight. For instance, in a preferred embodiment of the invention the abradable material is a mixture comprising about 93% nickel by weight, about 5% aluminium by weight, and about 2% binder by weight. Such a powder is sold by the US company Metco Inc. (of 1101 Prospect Avenue, N.Y. 11590) under the trademark METCO 450. This material is significantly cheaper than abradable materials conventionally used in turbines but has not previously been used in turbines because it has been thought that it would not be abradable enough and indeed might oxidise and harden thereby becoming abrasive. However, we have discovered that this material performs well in turbines, at least at temperatures below about 760° C.

The abradable coating may be applied to the surface of the turbine housing by any suitable method. In the case of the above preferred abradable material, the abradable layer is preferably applied by the conventional process of thermal spray coating. The application process is controlled so that the abradable layer has an appropriate porosity corresponding to a desired hardness (which may for instance depend on the material and construction of the turbine blades).

The abradable material may be applied to the surface of the turbine housing such that a base layer of the coating is relatively hard so that only outer regions of the layer are truly abradable. That is, the abradable layer may be applied in such a way that it is effectively only abradable up to a certain depth. However, reference to the "abradable layer" above and hereinafter are to be understood as references to the entire layer of abradable material applied to the turbine housing and not just that part of the layer which is in practical circumstances actually abradable. Thus, references to the thickness of the "abradable layer" below are to be understood as references to the thickness of the entire layer as applied to the turbine housing notwithstanding that the layer may not be considered to be abradable throughout its entire thickness.

The optimum thickness of the abradable layer will depend to a large extent on the size of the initial clearance between the turbine wheel and the turbine housing. The abradable coating is preferably as thick as possible for any given clearance whilst allowing the turbine to be self-starting. Thus the average thickness of the abradable layer is preferably about 0.1 mm less than the clearance between the turbine wheel and the housing.

For instance, within turbines incorporated in turbo-charges, the radial gap between the extreme tips of the turbine blades and the inner wall of the housing is generally less than 1 mm. Thus, for example, in a preferred embodiment of the invention the radial gap between the extreme tips of the turbine blades and the inner wall of the housing is about 0.5 mm and the thickness of the abradable layer is just less than the clearance gap at, for instance, about 0.4 mm.

In addition to the above detailed first aspect of the present invention, we have also discovered that significant performance improvements can be attained in centripetal compressors by the provision of an abradable coating on the compressor housing. That is, centripetal compressors generally comprise a compressor wheel mounted in a compressor housing which defines a generally cylindrical axial inlet passageway leading to the compressor wheel and a annular outlet passageway arranged around the compressor wheel. Although the construction of such compressors is broadly similar to that of turbines, problems associated with differential expansion of the compressor components have not previously been thought significant as the operating temperatures of compressors are generally substantially lower than the operating temperatures of turbines. However, we have discovered that measurable improvements in performance can be obtained by minimising the clearance gap between the compressor wheel blades and the compressor housing by the provision of an abradable coating on the surface of the housing adjacent to the compressor wheel blade tips.

Accordingly, a second aspect of the present invention provides a centripetal compressor comprising a housing, a compressor wheel mounted within the housing and having compressor blades, the housing being provided with an annular layer of an abradable material in a region adjacent said turbine blades.

In a preferred embodiment of the compressor the housing defines an inlet passageway which has a generally cylindrical portion arranged around a portion of the compressor wheel, an annular outlet passageway arranged around a portion of the compressor wheel, and a curved annular shoulder curving radially outwards from said generally cylindrical portion of the inlet passageway to said annular outlet passageway, the radially outer edge of each blade having a first portion adjacent the generally cylindrical portion of the inlet passageway, and a second curved portion adjacent the curved annular shoulder, and the annular layer of abradable material covers at least a part of said curved shoulder adjacent the compressor wheel blades.

As with the first aspect of the present invention, we have discovered that cost savings can be made, without significant detriment to performance, by applying the abradable coating only to that portion of the compressor housing adjacent the compressor wheel blades towards the outlet of the housing. Thus, in a preferred embodiment of the second aspect of the present invention the abradable coating covers at least a part of said annular shoulder but all, or substantially all, of said cylindrical portion of the inlet passageway is not covered by the coating.

Further savings in cost can be attained by covering only that portion of the annular shoulder which lies towards the annular outlet with said abradable coating. Thus, in a more preferred embodiment of the present invention, the abradable coating covers an area of the annular shoulder for which the curvature has a radial component which is greater than, or substantially equal to, its axial component.

The optimum thickness of the coating depends upon the size of the initial clearance gap between the turbine blades and the housing and is preferably as thick as possible whilst not preventing the compressor from starting under its own power. Typically, the thickness of the abradable coating will lie within the range of 0.1 mm to 0.5 mm.

There are many materials suitable for use as an abradable coating in compressors, which will generally have different specifications from materials used as abradable coatings in turbines. We have found that an abradable material that performs well is one comprising a mixture of an aluminium alloy powder, silicon and polyester. A preferred composition comprises about 60% by weight of the aluminium alloy, about 12% by weight of silicon and about 28% by weight polyester. (Such a material is sold by Metco Inc. under the trademark METCO 601).

The above preferred abradable material is preferably applied to the compressor housing by a plasma jet spray process. As discussed above in relation to the turbine, the abradable layer may actually be applied to the housing such that a base portion of the layer is relatively hard and thus not truly abradable. However, references to the thickness of the layer, both above and hereinafter, are to be understood as references to the thickness of the layer as applied to the housing regardless of whether or not the layer is actually abradable throughout its thickness.

SUMMARY OF THE DRAWINGS

Specific embodiments of the present invention will now be described, by way of example only, with reference to the accompanying drawings, in which.

DESCRIPTION OF THE INVENTION

Figures 1, 2, 3:
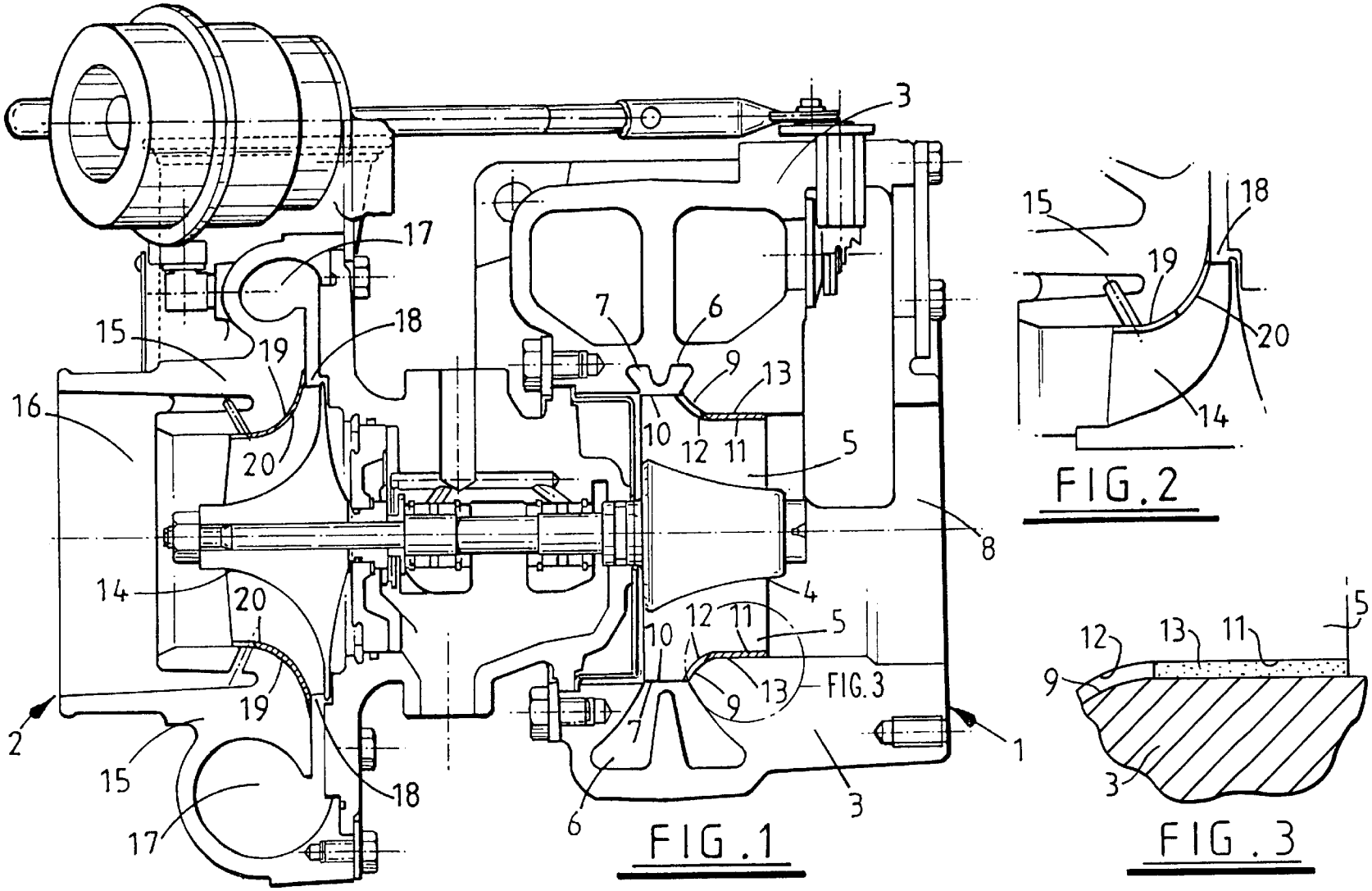
FIG. 1 is an axial cross-section of a turbo-charger incorporating a turbine and a compressor in accordance with the present invention.
FIG. 2 illustrates a modification of the compressor shown in FIG. 1.
FIG. 3 illustrates a greatly expanded view of an abradable coating used with the turbo-charger of FIG. 1, showing the region encompassed by circle 3—3.

Referring to the drawing, the illustrated turbo-charger is of a relatively conventionally design modified in accordance with the present invention. Accordingly, only features relevant to the various aspects of the present invention will be described in detail below.

The turbo-charger comprises a centripetal turbine, illustrated generally by the reference numeral 1, and a centripetal compressor, illustrated generally by the reference numeral 2. The turbine 1, comprises a housing 3 which houses a turbine wheel 4 which has radially extending blades 5. The housing 3 defines an annular inlet chamber 6 which has an annular passageway 7 arranged around a rear portion of the turbine wheel 4. The housing 3 further defines a generally cylindrical outlet passageway 8 a portion of which surrounds a front portion of the turbine wheel 4. Where the outlet passageway 8 meets the inlet passageway 7 the inner wall of the housing 3 curves radially outwards defining a curved annular shoulder 9.

The radially outer edge of each turbine blade 5 is profiled such that it has a rear relatively straight portion 10 which extends across the inlet passageway 7, a front relatively straight portion 11 which extends into the outlet passageway 8, and a curved portion 12 which follows the profile of the curved annular shoulder 9.

As discussed in the introduction to this specification, the blades 5 are profiled so that they closely follow the profile of the housing 3 to minimise the clearance gap therebetween. In the drawing the gap between the turbine blades 5 and the housing 3 is exaggerated to allow illustration of an abradable layer discussed below.

In accordance with the present invention, an annular layer 13 of an abradable material is provided on the surface of that part of the outlet chamber which surrounds the turbine wheel, i.e. the internal surface of the housing 3 adjacent the portions 11 of each turbine blade 5.

In the preferred embodiment illustrated, the radial gap between the outermost edges of the turbine blades 5 and the inner wall of the housing 3 is approximately 0.5 mm and the thickness of the abradable layer 13 is approximately 0.38 mm.

A variety of abradable materials could be used for the abradable layer 13, but in the illustrated preferred embodiment of the invention, the abradable material comprises 93% by weight nickel powder, 5% by weight aluminium powder, and 2% of an organic binder and was obtained from the company Metco Inc under the trade name METCO 450/17.

The illustrated turbine differs from conventional turbines provided with an abradable layer, in that all (or substantially all) of the curved annular shoulder 9 is left uncoated. This leads to a significant saving in the amount of abradable material needed (and thus a significant reduction in manufacturing cost) with very little loss in performance. In fact, in tests performance losses have proved to be too slight to properly measure.

In addition to the saving on the amount of material used, the present invention also provides a saving in cost by utilising a relatively cheap material, i.e. METCO 450/17 powder, which has previously been thought unsuitable for use in this application (as discussed above).

The abradable layer 13 may be applied to the surface of the housing 3 using any suitable process, for instance by a process of thermal spray coating. Such a process is well known and thus will not be further discussed here. The abradable material is applied so that it has a porosity corresponding to the desired hardness, and is preferably applied by first forming a relatively hard (and thus relatively non-abradable) base layer onto which a softer layer is formed. For instance, an appropriate hardness for the upper abradable region of the layer 13 is given by the specification $R^{15Y}=70\pm5$.

Referring again to the drawing, the compressor 2 has a similar structure to that of the turbine I and comprises a compressor wheel 14 mounted on the same axis as the turbine wheel 4 within a housing 15. The housing 15 defines a generally cylindrical inlet passageway 16 which leads to the compressor wheel 14 and a portion of which surrounds a front portion of the compressor wheel 14. The housing 15 further defines an annular outlet chamber 17 which has an annular outlet passageway 18 which surrounds a rear portion of the compressor wheel 14. Between the inlet passageway 16 and the outlet passageway 18 is a curved annular shoulder 19.

The illustrated compressor 2 differs from conventional compressors in that an annular layer 20 of an abradable material is applied to the surface of annular shoulder 19. Provision of the abradable layer 20 has made it possible to effectively reduce the clearance between the compressor wheel 14 and the housing 15 which has produced a measurable improvement in performance. Tests have shown that providing the abradable layer 20 as illustrated results in about a 4% increase in the pressure coefficient of the compressor 2.

As in the case of the turbine described above, it is not necessary for the annular layer 20 of abradable material to cover all of the inner wall of the housing 15 adjacent the compressor wheel 14; significant cost savings can be attained (with minimal effect on performance) by covering only the annular shoulder 19 which leads to the annular outlet passageway 18, as illustrated. Even greater savings can be attained by covering only that part of the shoulder 19 which lies towards the outlet 18. For instance, the abradable layer 20 may cover that region of the annular shoulder 19 which extends from the outlet passageway 18 to a region at or adjacent the region of the shoulder at which the radial component of its curvature is roughly equal to its axial component. This is illustrated in FIG. 2.

It will be appreciated that there are a variety of materials which could be used for the abradable layer 20. However, in the preferred embodiment illustrated the abradable material is a powder comprising 60% by weight of aluminium alloy, 12% by weight of silicon, 28% by weight of polyester, obtained from the company Metco Inc under the trade name METCO 601. This particular powder is chosen because it is soft and abradable enough not to damage the relatively thin blades of the compressor wheel. This powder has a higher melting point than the METCO 450 powder mentioned above, and therefore is applied to the surface of the compressor housing by a plasma jet spray process. The plasma jet spray process is a conventional process and will not be discussed in detail here.

The thickness of the abradable layer 20 should be as large as possible whilst not preventing the compressor from self-starting. In the preferred embodiment illustrated the thickness of the layer 20 is about 0.5 mm. As discussed above in relation to the abradable layer 13 applied to the turbine, in practice the abradable material is preferably applied to the surface of the housing so as to initially form a relatively hard (and thus non-abradable) base layer. That is, the abradable layer will not be practically abradable throughout its entire thickness.

It will be appreciated that the present invention is applicable to turbines and compressors employed in many different applications and is not limited to turbo-chargers. Similarly, it will be appreciated that many of the details of the turbo-charger illustrated could be modified.

As regards the layers of abradable material, it will be understood that their thickness and exact positioning could vary, for example with varying turbine/compressor structures. For instance, in larger turbo-chargers the clearance between the turbine blades and the housing may be about 0.8 mm, in which case the thickness of the abradable layer is preferably about 0.7 mm (e.g. about 0.68 mm). In addition, in the case of the turbine the abradable layer need not necessarily cover all of that portion of the outlet passageway that surrounds the turbine wheel, but could for example terminate before the curved annular shoulder and/or short of the front end of the turbine wheel.

I claim:

1. A centripetal turbine comprising a housing, a turbine wheel mounted within the housing and having turbine blades each having a radially outer edge, the housing defining an annular inlet passageway arranged around a portion of the turbine wheel, an outlet passageway which has a generally cylindrical passageway arranged around a portion of the turbine wheel, and a curved annular shoulder curving radially outwards from said generally cylindrical portion of the outlet passageway to said annular inlet passageway, the radially outer edge of each blade having a first portion adjacent the generally cylindrical portion of the outlet passageway, and a second curved portion adjacent the curved annular shoulder, wherein the housing is provided with an annular layer of an abradable material covering substantially all of said substantially cylindrical portion of the outlet passageway and at most only a relatively small annular portion of the curved shoulder adjacent said cylindrical portion of the outlet passageway.

2. A centripetal turbine according to claim 1, wherein the layer of abradable material covers only said substantially cylindrical portion of the outlet passageway.

3. A centripetal turbine according to claim 2, wherein the abradable material comprises a mixture of nickel powder, aluminum powder and a binder.

4. A centripetal turbine according to claim 3, wherein the binder is an organic binder.

5. A centripetal turbine according to claim 4, wherein the abradable material comprises from about 90% to about 96% by weight of nickel powder and about 3% to about 7% by weight of aluminum powder.

6. A centripetal turbine according to claim 5, wherein the abradable material comprises about 93% by weight of nickel and about 5% by weight of aluminum.

7. A centripetal turbine according to claim 6, wherein the abradable material is applied to the surface of the turbine housing by a process of thermal spray coating.

8. A centripetal turbine according to claim 7, wherein the average thickness of the abradable layer is about 0.1 mm less than the radial clearance between the turbine wheel and the turbine housing in the region of the abradable layer.

9. A centripetal turbine according to claim 8, wherein the average thickness of the abradable layer is between about 0.1 mm and about 0.9 mm.

10. A centripetal turbine according to claim 9, wherein the layer of abradable material has an average thickness of about 0.4 mm.

11. A centrifugal compressor comprising a housing, a compressor wheel mounted within the housing and having compressor blades, the housing being provided with an annular layer of an abradable material in a region adjacent said compressor blades, wherein the housing defines an inlet passageway which has a generally cylindrical portion arranged around a portion of the compressor wheel, an annular outlet passageway arranged around a portion of the compressor wheel, and a curved annular shoulder curving radially outwards from said generally cylindrical portion of the inlet passageway to said annular outlet passageway, the radially outer edge of each blade having a first portion adjacent the generally cylindrical portion of the inlet passageway, and a second curved portion adjacent the curved annular shoulder, wherein the annular layer of abradable material covers at least part of said curved shoulder but all, or substantially all, of said cylindrical portion of the inlet passageway is left uncovered by said layer of abradable material.

12. A centrifugal compressor according to claim 11, wherein the layer of abradable material covers only a region of said annular shoulder in which the curvature of the shoulder has an axial component which is greater than, or substantially equal to, its axial component.

13. A centrifugal compressor according to claim 12, wherein the average thickness of the layer of abradable material is about 0.1 mm less than the radial clearance between the compressor wheel and the housing in the region of the abradable layer.

14. A centrifugal compressor according to claim 13, wherein the average thickness of the abradable layer is between about 0.1 mm and 0.5 mm.

15. A centrifugal compressor according to claim 14, wherein the abradable material comprises a mixture of an aluminum alloy powder, silicon and polyester.

16. A centrifugal compressor according to claim 15, wherein the abradable material comprises about 60% by weight of said aluminum alloy powder, about 12% by weight of silicon and about 28% by weight of polyester.

17. A centrifugal compressor according to claim 16, wherein the layer of abradable material is applied to the compressor housing by a plasma jet spray process.

18. A turbine comprising a housing, a turbine wheel mounted within the housing and having turbine blades, the housing being provided with an annular layer of an abradable material in a region adjacent said turbine blades, wherein said abradable material comprises about 93% by weight of nickel powder, about 5% aluminum powder by weight, and a binder.

* * * * *